US005433546A

United States Patent [19]

Kershaw

[11] Patent Number: 5,433,546

[45] Date of Patent: Jul. 18, 1995

[54] PLANNING AND JOURNAL APPARATUS AND METHOD

[76] Inventor: Samuel H. Kershaw, 1956 E. Brandon Park Pl., Sandy, Utah 84092

[21] Appl. No.: 255,434

[22] Filed: Jun. 8, 1994

[51] Int. Cl.[6] ..... B42F 13/00

[52] U.S. Cl. ..... 402/79; 281/38

[58] Field of Search ..... 281/38, 42, 51; 283/55, 283/66.1, 66.2, 115, 116, 2

[56] References Cited

U.S. PATENT DOCUMENTS 5,188,562 2/1993 Carley ..... 402/79 X
5,263,744 11/1993 Linder ..... 283/115
5,333,908 8/1994 Dorney et al. ..... 402/79 X
5,346,326 4/1994 Bienvenu ..... 402/79

*Primary Examiner*—Willmon Fridie

*Attorney, Agent, or Firm*—J. Winslow Young

[57] ABSTRACT

A planning and journal apparatus and method wherein a loose-leaf binder has mounted therein a plurality of indices, each index addressing a particular topic, one topic being a journal designed for regular journal entries. A week manager sheet is readily insertable between the pages of the journal without the necessity of opening and closing the rings of the loose-leaf binder. The week manager sheet selectively includes a subtask column to enable the user to readily identify various subtasks on a weekly basis. The week manager sheet is configured as a two-sided sheet and having ring-receiving holes along opposing margins. The holes are slit to the edge of the week manager sheet to allow each hole to be slipped over and removed from the respective ring without opening the rings.

17 Claims, 9 Drawing Sheets

PLANNING AND JOURNAL APPARATUS AND METHOD

BACKGROUND

1. Field of the Invention

This invention relates to planning systems and, more particularly, to a novel manager/organizer and journal apparatus and method wherein various subject headings are segregated by a separate index and a novel weekly manager/organizer sheet is configured to be selectively insertable into the daily journal portion of the manager-/organizer and journal. Each index page includes a miniaturized reprint of the sheet designated by that particular index heading along with an instructional guide for using the sheet.

2. The Prior Art

The recent past has witnessed the proliferation of various devices and daily planner systems for planning daily activities, scheduling appointments, setting goals, etc., as well as providing a vehicle for the user to make regular entries into a daily journal. A daily journal is also a useful tool to encourage a person to be more observant and retrospective. Generally, the conventional daily planner system involves a special loose-leaf binder into which preprinted pages are inserted. The pages are based on a daily system in which one or both facing pages of the opened planner display the same date. For example, one system is configured as a two-page per day system with the left-hand page carrying topics such as Appointments and Scheduled Events, To Be Done Today, and an Expense and Reimbursement Record, while the right-hand page has the heading of Diary and Work Record. Another popular planner devotes the left-hand page to a miniature calendar for the month along with the topics of Prioritized Daily Task List, Daily Expenses, and Appointment Schedule while the right-hand page is designated with the topic of Daily Record of Events. Other planner systems follow this same general trend of incorporating a daily journal as part of the daily planning page.

These prior art systems are faulty for a number of reasons primary among which is the fact that one rarely fills an entire page on the right-hand or diary page. Also, in the event there is more to record than space provided, there is no further space in which to make such a record for that day. Further, in the event it is necessary to reschedule a low priority item, the user must reenter the item on the next succeeding page or pages. Aside from these minor frustrations, perhaps one of the more cumbersome aspects of the various current, daily planner systems is that if an assignment is received or a delegation made and such an entry is made in the customary diary or journal page (right-hand), the user must scan a number of these pages in order to retrieve the particular assignment/delegation of interest. This means that there is a high probability that an assignment/delegation will be inadvertently overlooked.

I have also found that there is a tendency to commingle journal entries with assignments, delegations, appointments, and the like with the result that unless one carefully extracts these assignments, etc., from the daily journal on a regular basis, such assignments, etc., can easily become overlooked and thereby forgotten. This event can easily discourage the user from using and consulting the planner on a regular basis. Further, in order to effectively utilize the planner the user must abstract each day's entries and re-enter relevant notations on the next succeeding day or days of the binder. This is cumbersome and can result in the user abandoning the planner system in its entirety.

In view of the foregoing, it would be an advancement in the art to provide a planning system wherein both sides of a single page contain the daily schedule of tasks and appointments along with an agenda for an entire week at a time. It would also be an advancement in the art to provide this weekly page as an easily insertable and removable page that can be turned to place the opposite face outward and also inserted between succeeding pages of the diary or journal portion of the planner without opening the rings of the binder. It would also be an advancement in the art to provide the planner with a separate index for topics such as Assignment, Delegation, Forms, Goals, Periodic, References, and Subtasks whereby specific items are entered for ease of access. It would be an even further advancement in the art to provide each index page with a miniaturized reprint of the specific page covered by that index heading along with a detailed description on how to use the pages designated by that particular index page. Such a novel apparatus and method is disclosed and claimed herein.

BRIEF SUMMARY AND OBJECTS OF THE INVENTION

This invention involves the incorporation of a novel page and index concept along with a novel system for enabling the user to more efficiently utilize the novel page in combination with the daily journal. The novel page is configured as a "Weekly Manager/Organizer" with each day of the week designated as a separate portion on the weekly page. A separate column on the Weekly Manager/Organizer page is used to set forth the daily agenda for achieving the specific goals of the day. Another column contains an abbreviated appointment schedule for each day of the week. The page is a two-sided page having three days on the front (Monday, Tuesday, and Wednesday) and four days on the back (Thursday, Friday, Saturday, and Sunday). Each vertical edge of the page has a row of holes configured to engage the corresponding rings of a binder. A transverse slit at each hole allows the page to be easily removed, turned over and/or reinserted in the binder without opening the rings of the binder. Separate indices are provided for specific topics and each index page includes a miniaturized reprint of the page designated by the index along with instructions for implementing the program of the specific topic contained on the index page for each topic.

It is, therefore, a primary object of this invention to provide improvements in planners.

Another object of this invention is to provide improvements in the method of planning activities, scheduling appointments, setting goals, and the like.

Another object of this invention is to provide a weekly page of appointments and schedules as a page that is readily movable within the pages of the journal portion of the planner in the absence of opening the rings of the binder.

Another object of this invention is to provide the weekly planning page with holes punched along both margins and with a slit connecting each hole to the edge of the page to accommodate the page being removably inserted in the binder without opening the rings of the binder.

Another object of this invention is to provide a weekly planning page that is disposable after use.

Another object of this invention is to provide a weekly planning page that can be readily removed, turned over, and reinserted in the binder to have the current days of the week open to the current day of the journal.

Another object of this invention is to provide a topic index sheet with instructions for use of the sheets under that topic index displayed on the topic index sheet.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENT

Figure 1:
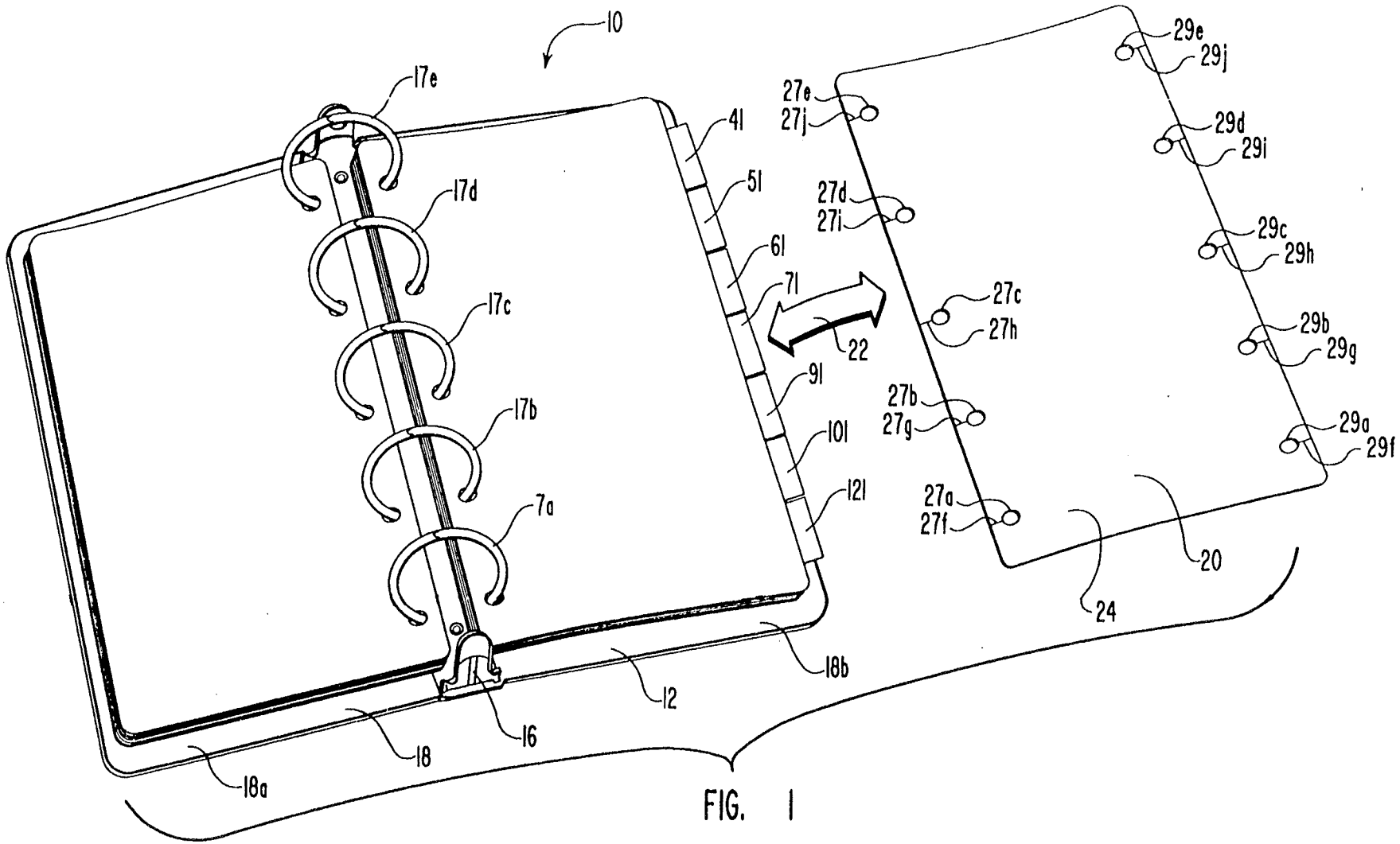
FIG. 1 is a perspective view of the novel Week Manager sheet of this invention shown in the environment of a ring binder.

The invention is best understood from the following description in conjunction with reference to the accompanying drawing wherein like parts are designated by like numerals throughout.

General Discussion

We live in a fast-paced world with events crowding in on us from every corner. The result tends to be a sort of mild panic that there are too many things coming at you from too many directions with the resultant feeling that you are drowning in a maelstrom of conditions over which you have no control. There are errands to run, telephone calls to return, appointments to make and keep, assignments to perform and to delegate, etc. The list almost seems endless so that one does not know where to begin or how one will ever cope with everything. The resultant factor from this overwhelmed feeling is one of great debilitating fatigue. One may have been up for only an hour or so, but suddenly there is a feeling of intense fatigue such that one merely wants to curl up somewhere and sleep for days. It is believed among professionals in the field that this is a very common syndrome in the Western World these days, possibly throughout the world.

Organization and prioritization provide the solution to this problem thereby enabling one to develop the attitude that says, "I will do what I can, in good time, and in a relaxed, controlled way, the rest can wait until tomorrow." This allows one to stay calm, handle events one at a time, and eventually take care of all the important issues each day without developing a feeling of being overwhelmed.

Every human being thrills at the thought of achievement. Achievement means different things to different people. To one it may mean physical health and the ability to participate in physical activities. To another, it may mean abundance, money, etc., and yet to another it may mean education, or the ability to get along well with other people. Whatever the particular achievement or happiness may mean to the individual, each individual always desires a larger amount of it, a closer affiliation with it.

The ability to control, to the extent possible, one's experiences and to have them result in achievement, happiness, prosperity, and success lies within one's grasp by the way one utilizes time and energy. This means that each controls his/her own experiences so that each is really in charge of his/her affairs and the way they are to develop. In summary, the basic idea is really quite simple, we become what we think and we obtain that which we seriously seek.

Almost every individual encounters problems with procrastination, goal setting, record keeping, particularly with respect to assignments received and delegations made, as well as regular journal entries, and the like, to name a few. Procrastination, for example, can signal a deeper, underlying problem or conflict about something, perhaps a fear of being evaluated, a fear that one may be too successful and thus not be liked, a fear of giving in too much or of losing yourself in your work. Just because a person will occasionally put things off does not mean he or she is a procrastinator. However, procrastination is a real problem for individuals whose habitual failure to act in a timely manner in confronting new opportunities or ordinary responsibilities seriously interferes with their careers and even their lives.

Perhaps the biggest problem for most procrastinators is getting started. However, this problem is also usually coupled with the tendency for procrastinators to think big which means that they tend to think in terms of "I have all this to do, I need a whole day to do it, I have to do it really well and do it all at once." The solution to this dilemma is for the person to break the task down into subtasks and set a goal for achieving the particular subtask.

In the matter of goals, a number of years ago a survey was made among several hundred executives. Each was asked what he or she wanted out of life. The interviewers asked for goals, both short and long range. The survey produced some very interesting information. Only three out of each one hundred people interviewed had definite goals. Another ten had some goals, but these goals were stated with reservations or qualifications. The remaining eighty-seven people had no clearly stated goals whatsoever which is quite a shocking situation. Clearly, the answer is for people to set realistic goals, with short and long range, and then set forth a strategic and tactical plan for achieving these goals.

Stress in a person's life is one result of procrastination and its accompanying lack of proper goal setting. While a certain amount of stress is necessary for a person's well being, stress overload is the number one health problem today in our nation's work force. The American Institute of Stress estimates that stress related ailments cost employers in the United States nearly $200 billion annually in lost productivity, absenteeism, and direct medical and insurance claims. Stress affects our thinking, emotions, and behavior, and can ruin our physical well being. Unchecked, stress can devastate a professional career, tear apart business and family relations, and even destroy lives.

Everyone, to one degree or another, works in a highly competitive, fast-paced, demanding environment where superior individual performance, productivity, and meeting deadlines are keys to our success. How we recognize and handle these stresses can either energize us or kill us, literally. In order to cope with the adverse stresses in our lives we must learn to maintain a good attitude, expect more good than bad, make up our minds to be more cheerful, and gain control of our daily and weekly schedules by thoughtful, goal-oriented planning.

In a recent study of stress it was determined that even as life becomes more stressful, all human beings must be reasonably certain of three things in order to remain on an even keel. First, each needs the knowledge and technology with which to control the material universe, protect our health and welfare, and hopefully control disease and defer inevitable death. Second, we require friends, including family members. We cannot live alone in the world, otherwise, we feel isolated and unprotected. Third, we need some kind of belief, religious or philosophical, to bolster our conviction that life has meaning, that a human is not just another animal.

Uncertainty in any of these three areas is the principal source of stress facing a person, and uncertainty is ever increasing. Not only does uncertainty produce stress, if continued for long enough periods, stress can lead to serious illness or manifest itself through anxiety, spreading inhibitions, phobias, stereotyped rituals, psychosomatic disorders, impaired social interaction, addiction to alcohol and other drugs, regressions to immature patterns of behavior, and other marked and persistent deviations in conduct.

It was in recognition of these problems and the inherent failure of the current, commercially available planners that I developed my unique system. In particular, after a careful scrutiny of the plethora of planning systems available, I determined that while each has certain redeeming features they all were deficient in certain aspects as tools for helping a person set and achieve realistic goals, reduce the tendency to procrastinate, and achieve balance in life with regard to stress.

First, I designed my unique planning system along the lines of a daily journal but with a separate page that presents a week's scheduling at a glance. This novel week planning sheet can be selectively removed and reinserted at preselected places in the journal portion of the planner to enable the user to more easily maintain control over the daily schedule on a weekly basis. In effect, the week planning sheet is a "floating" reminder sheet that can be easily placed at any preselected location in the planner. A particular advantage to this system is that it is goal oriented versus task oriented. Further, it enables the user to combine planning activities with execution of those planning activities that are associated.

Specifically, I have designed my unique planner to enable the user to intensely plan once a week and yet manage each day. This is accomplished by using the subtask system I have designed in that the various subtasks are set forth on the week planning sheet where they are readily observed. In the event there are extensive subtasks to be performed, these additional subtasks can be placed under a separate index heading. This technique eliminates the entry of these important items onto the journal pages where they can become misplaced and overlooked. The use of my novel subtask system also readily enables the user to more easily coordinate the various tasks so identified to facilitate their timely completion. The index for overflow subtasks also allows the user to carry the list of subtasks from week to week.

Another novel feature of my week planning sheet is that it contains a line of holes along each edge of the sheet so as to enable the week planning sheet to be flipped over to reveal its reverse side without changing the placement of the sheet in the binder. This feature places the "active" side of the week planning sheet at a position where it is always facing the journal entry page for that day. Advantageously, each hole along each side of the sheet includes a slit that enables the user to remove and insert the sheet on the rings of the binder without necessity of opening the rings of the binder. This unique feature allows the user to "flow" the week planning sheet through the journal portion of the planner.

Another important feature of this invention is the segregation of the various subjects under different indices to enable the user to more readily access each subject and thereby eliminate the tedium of searching the journal portion of the planner for the various assignments, delegations, etc., that would otherwise be scattered therethrough. Accordingly, it is a simple task to turn to each index to review the subject matter thereof during the planning process. Another significant advantage to my novel planner apparatus is that each of the index pages includes a copy of a reduced page covered by that particular index along with instructions for the use of that particular page designated by that index. In this way the user is constantly reminded about how to use the page thus enhancing the efficiency with which each page is used. This feature also readily provides access to the various headings for fingertip reference.

Detailed Description

Referring now to FIG. 1, the novel planner of this invention is shown generally at 10 and includes a binder 12 configured as a loose-leaf, ring binder having a plurality of rings 17*a*–17*e* mounted to a spine 16 and enclosed by a folding cover 18 having of a front cover 18*a* and a back cover 18*b*. Binder 12 is a conventional binder and is shown herein generally in order to more clearly set forth the novel features of this invention. Importantly, binder 12 can be any suitable binder having any suitable number of rings and being of any suitable size.

Figure 2A:
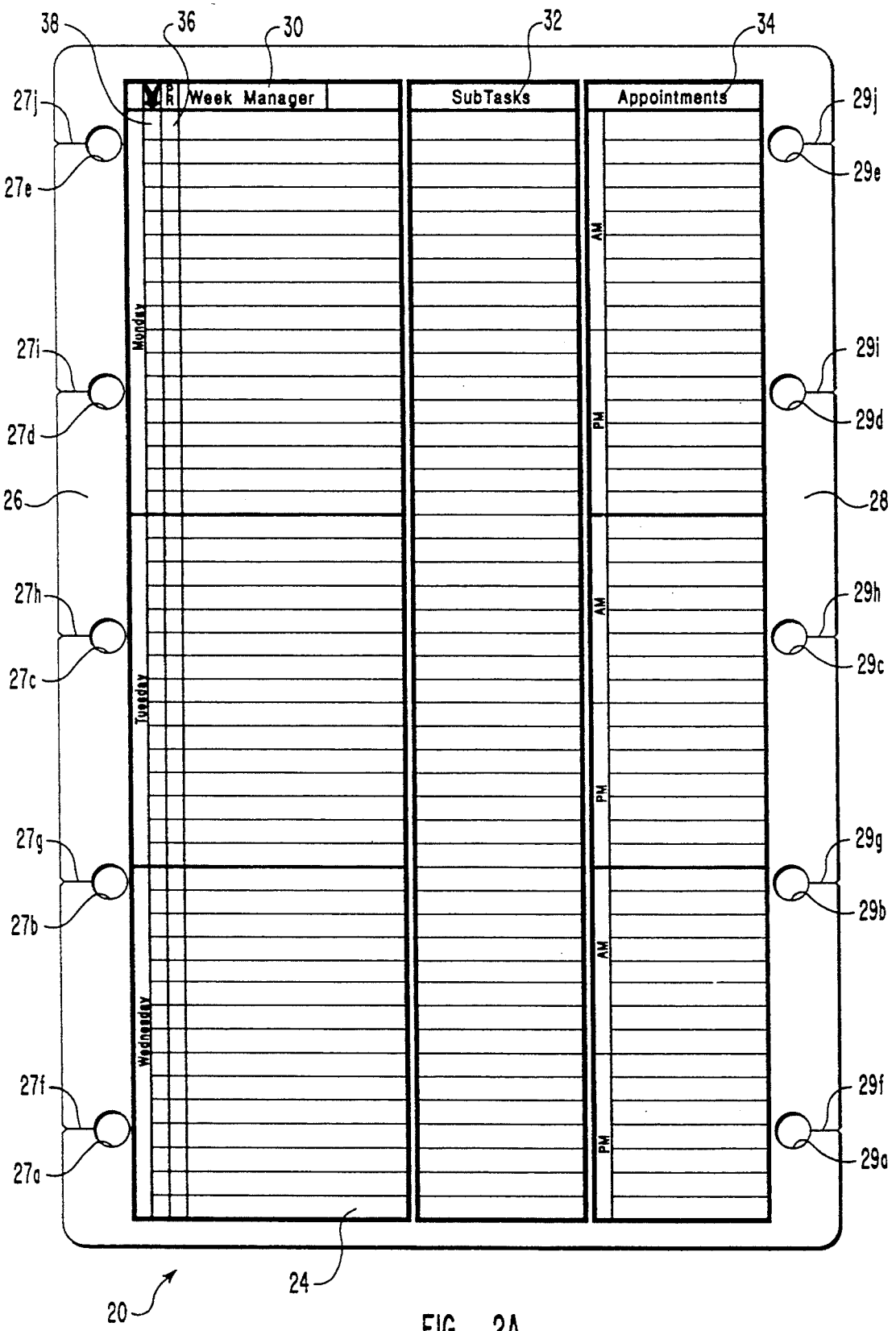
FIG. 2A is a plan view of a front side of a first embodiment of the Week Manager sheet.
Figure 2B:
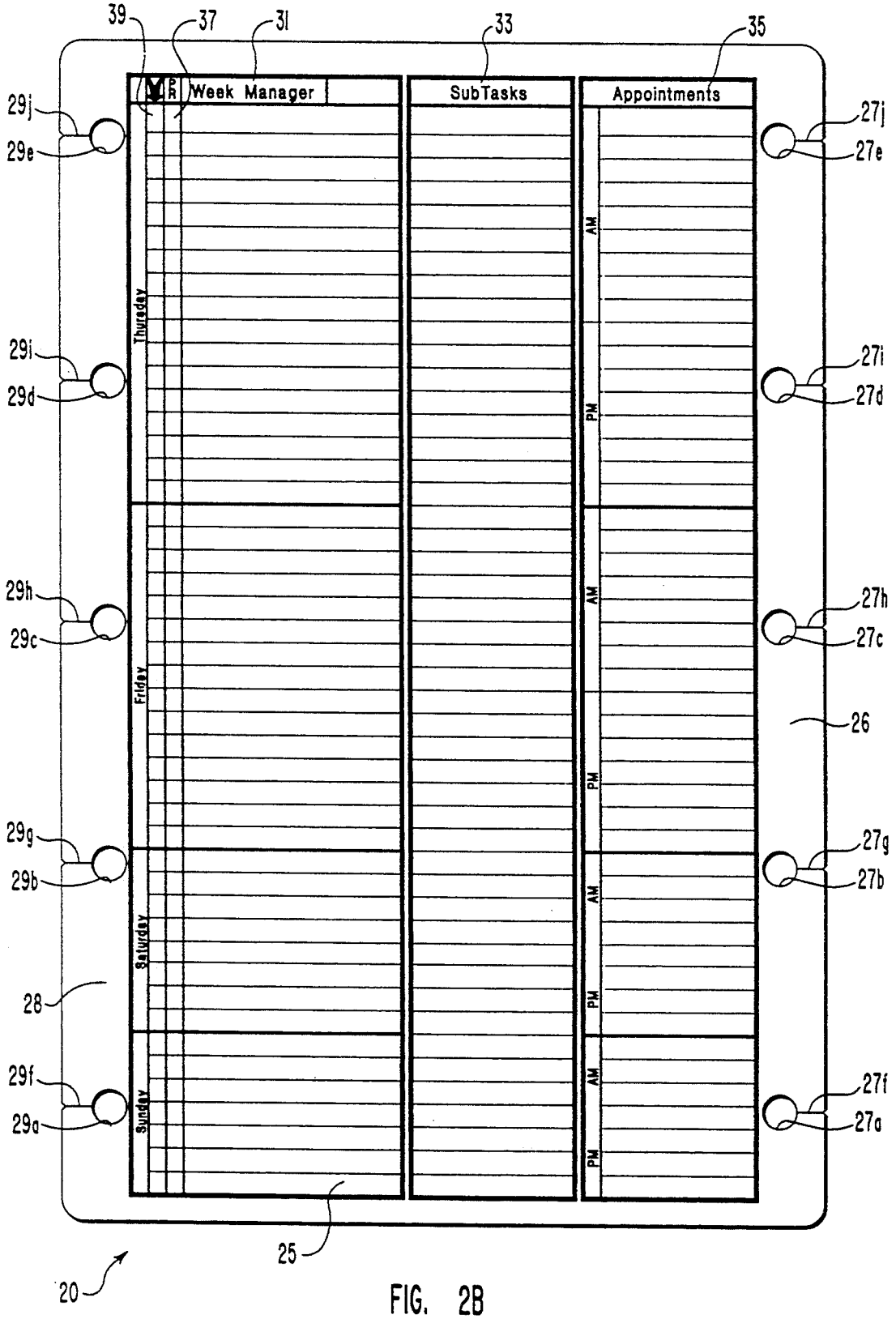
FIG. 2B is a plan view of the reverse side of the Week Manager sheet of FIG. 2A.

Associated with binder 12 in FIG. 1 is Week Manager sheet 20 with arrow 22 schematically illustrating one novel feature of this invention, namely, that Week Manager sheet 20 is easily removable and insertable in binder 12. Referring also to FIGS. 2A and 2B, Week Manager sheet 20 is configured as a two-sided sheet having a front 24 (FIG. 2A) and a back 25 (FIG. 2B).

Front 24 includes a left side 26 having spaced holes 27*a*–27*e* punched therethrough and a right side 28 having spaced holes 29*a*–29*e* punched therethrough. Holes 27*a*–27*e* and 29*a*–29*e* are dimensionally configured to engage rings 17*a*–17*e*, the particular set of holes used being determined by whether front 24 or back 25 is to be placed facing outwardly in binder 12 and on which side of binder 12, right or left.

Referring now more particularly to FIG. 2A, front 24 is shown laid out in three vertical columns: Week Manager column 30, Subtask column 32 and Appointments column 34. Vertically, Week Manager column 30 is segregated into three daily segments, Monday, Tuesday, and Wednesday. This same daily division is also carried over into Appointments column 34. Appointments column 34 is further segregated into an upper, AM segment and a lower, PM segment for each portion of the designated days. Subtask column 32 is not segregated into segments but is formed as a continuous vertical column along the entire length of front 24. Two, narrow, vertical columns are formed along the left side of Week Manager column 30 and serve as a priority column 36 and a status column 38 for use with respect to a particular task listed in Week Manager column 30 has been accomplished. Front 24 thereby presents at a glance to the user (not shown) the entire schedule for three days, Monday, Tuesday, and Wednesday, including all items requiring attention, their status, and priority, in addition to any appointments scheduled for these days.

Referring now to FIG. 2B, back 25 is shown having three generally identical vertical columns as presented on front 24 (FIG. 2A), and include Week Manager column 31, Subtask column 33, and Appointments column 35, along with a Priority column 37 and a Status column 39. The sole difference between front 24 and back 25 is that back 25 is segregated horizontally into the remaining four days of the week, Thursday, Friday, Saturday, and Sunday. The space occupied by Saturday and Sunday is approximately equal to the space occupied by Wednesday on front 24 (FIG. 2A); otherwise, back 25 is essentially identical to front 24.

Importantly and advantageously, Week Manager sheet 20 is configured with identical sets of holes 27*a*–27*e* and 29*a*–29*e* on each edge, edge 26 and edge 28, respectively. Each hole in each of these sets of holes includes a slit, shown as slits 27*f*–27*j* and slits 29*f*–29*j* extending between holes 27*a*–27*e* and holes 29*a*–29*e*, respectively, and the exterior of edge 26 and edge 28, respectively. Slits 27*f*–27*j* along with corresponding slits 29*f*–29*j* allow Week Manager sheet 20 to be easily inserted into binder 12 at any preselected location without the necessity of opening rings 17*a*–17*e*. Specifically, slits 27*f*–27*j* are forcibly pressed against rings 17*a*–17*e* causing the respective rings 17*a*–17*e* to enter holes 27*a*–27*e*. Correspondingly, slits 29*f*–29*j* at holes 29*a*–29*e*, respectively, enable these holes to selectively receive therein rings 17*a*–17*e*, respectively. This unique feature creates Week Manager sheet 20 as a "floating sheet" in that it is easily inserted into and removed from binder 12 at any preselected position in binder 12 thereby enabling Week Manager sheet 20 to "flow" through the pages of binder 12.

Figure 3:
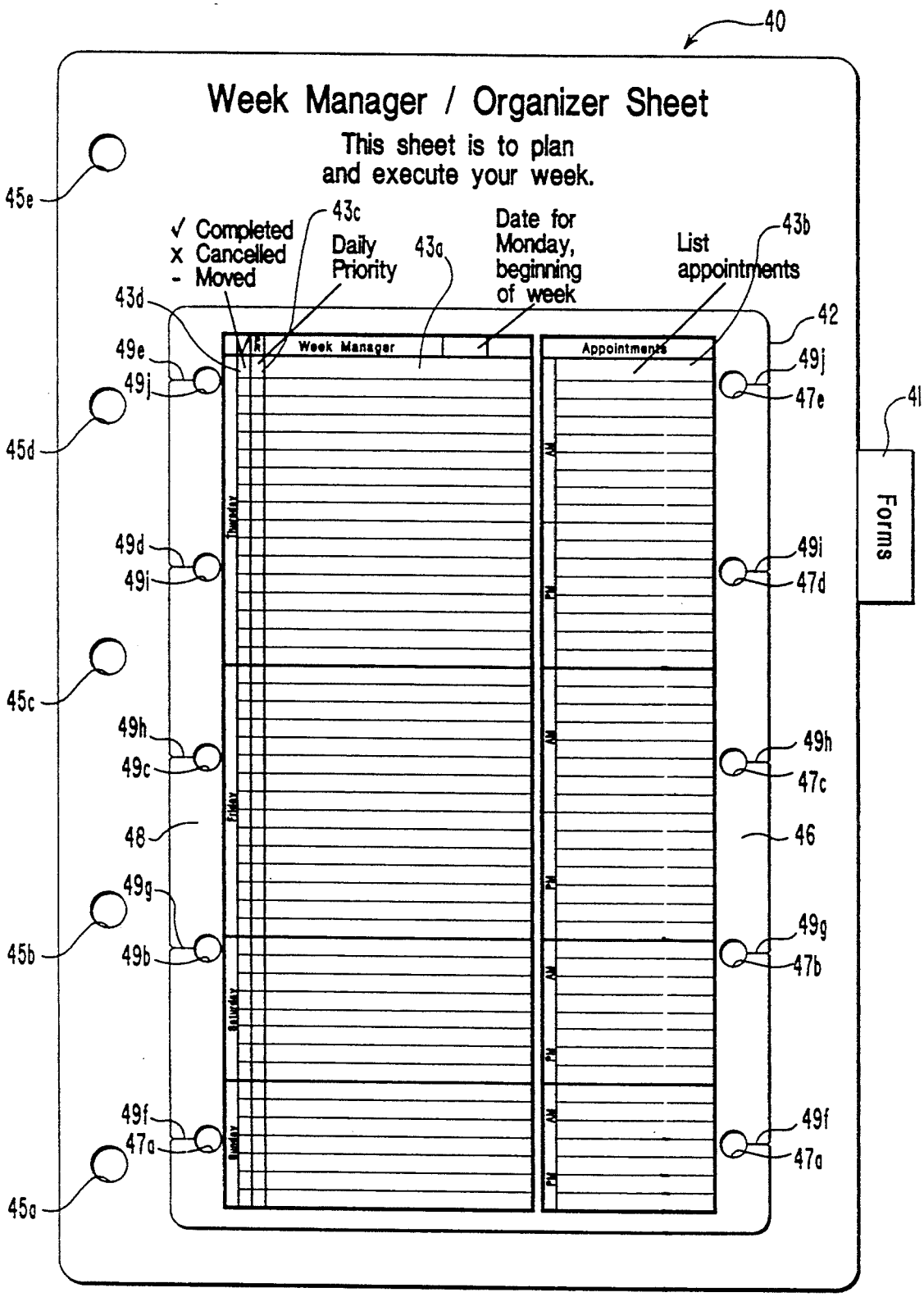
FIG. 3 is a plan view of the back side of a second embodiment of the Week Manager sheet.

Referring now to FIG. 3, a Week Manager/Organizer index page is shown generally at 40 and includes an index tab 41 with the designation FORMS thereon. Week Manager/Organizer index page 40 has printed thereon in reduced format the back side of a second embodiment of a Week Manager sheet 42. Week Manager sheet 42 is identical in all respects to Week Manager sheet 20 (FIGS. 2A and 2B) with the exception that Week Manager sheet 42 does not include a Subtasks column similar to Subtasks column 32 (FIG. 2A) and Subtasks column 33 (FIG. 2B). Week Manager sheet 42 does include a Week Manager column 43*a*, an Appointments column 43*b* along with a Priority column 43*c* and a Status column 43*d*. Week Manager sheet 42 includes a right margin 46 having a plurality of holes 47*a*–47*e* with slits 47*f*–47*j*, respectively, therein and a left margin 48 having a plurality of holes 49*a*–49*e* with slits 49*f*–49*j*, respectively, therein. At this juncture, it should be pointed out that Week Manager sheet 42 illustrated herein is the back side showing the four days of the end of the week, Thursday, Friday, Saturday, and Sunday. However, regardless which side is shown, the same features of Week Manager sheet 20 apply to Week Manager sheet 42 in that it is used within the pages of the journal portion of binder 12 to help organize the scheduling, etc., for the user (not shown).

Week Manager/Organizer index page 40 includes a plurality of spaced holes 45*a*–45*e* along the margin opposite index tab 41. Holes 45*a*–45*e* are configured to engage rings 17*a*–17*e* of binder 12 (FIG. 1). Week Manager/Organizer index page 40 also includes instructional text in conjunction with Week Manager sheet 42 to provide the user (not shown) with simple instructions for the use of the various features thereof.

Figure 4:
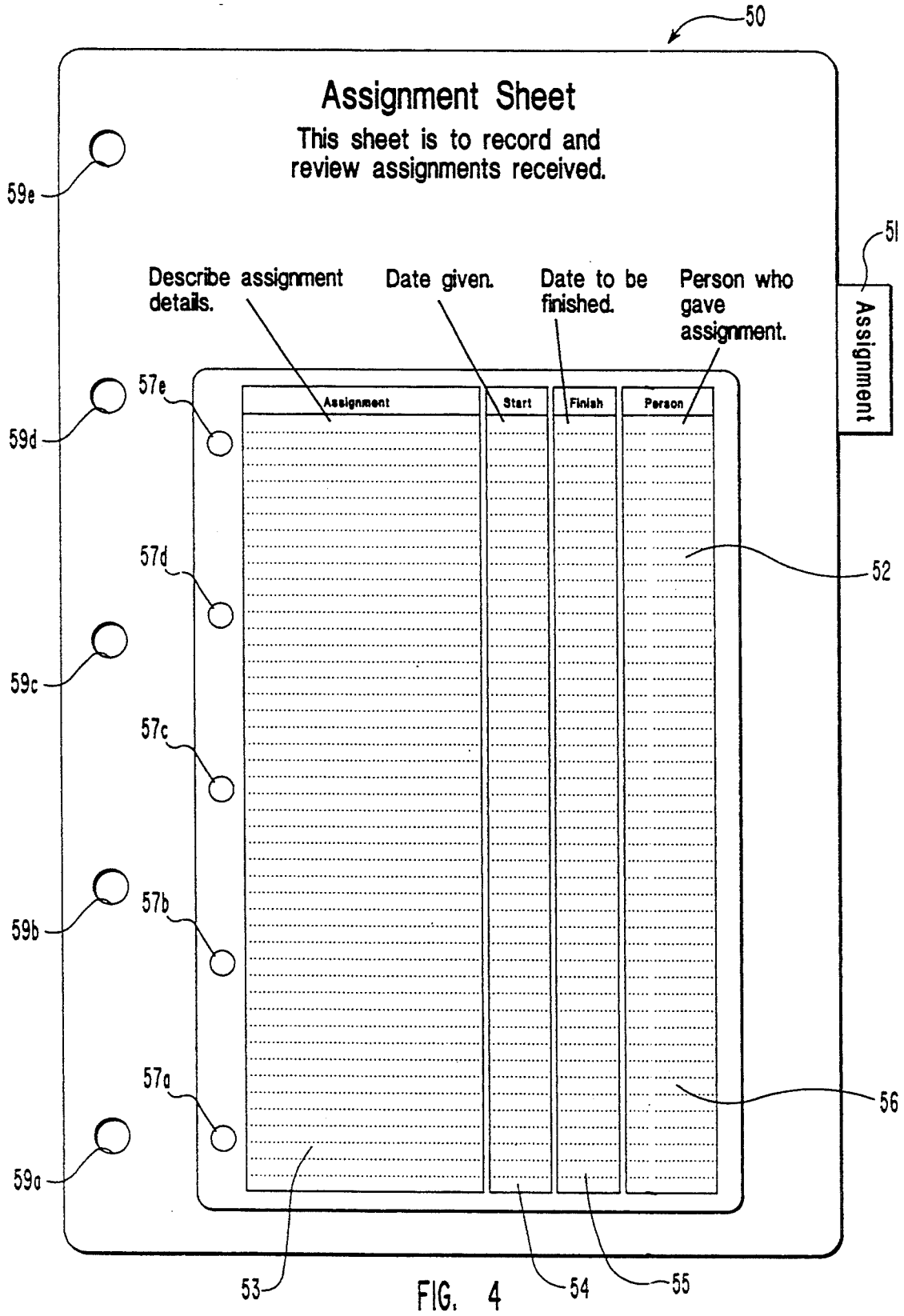
FIG. 4 is a plan view of the Assignment index sheet showing a sample of an Assignment sheet reduced in size and with accompanying instructions for use.

Referring now to FIG. 4, the Assignment index of this invention is shown generally at 50 and includes an Assignment sheet 52 reprinted thereon in a reduced format and also includes an index tab 51. Assignment index 50, as the name implies, is designed to serve as the specific index in binder 12 (FIG. 1) for a plurality of Assignment sheet 52 and as such includes a plurality of holes 59*a*–59*e* for engagement over rings 17*a*–17*e*, respectively, of binder 12. Assignment sheet 52 on the face of Assignment index includes a descriptive text about the purpose for the various columns thereon. In particular, Assignment sheet 52 includes an Assignment column 53, a Start column 54, Finish column 55, and a Person column 56. Assignment column 53 is designed to enable the user to describe the particular assignment being assigned while Person column 56 is designed to identify the person from whom the particular assignment was received. Start column 54 and Finish column 55, as the names imply, set forth the dates the particular assignment was given and expected to be completed, respectively. Advantageously, Assignment sheet 52 readily enables the user to observe at a glance the particular assignment or assignments requiring attention, the date for anticipated completion, and the person to whom the completed assignment is to be reported. Assignment sheet 52 includes holes 57*a*–57*e* for removable securement to rings 17*a*–17*e*, respectively, of binder 12.

Figure 5:
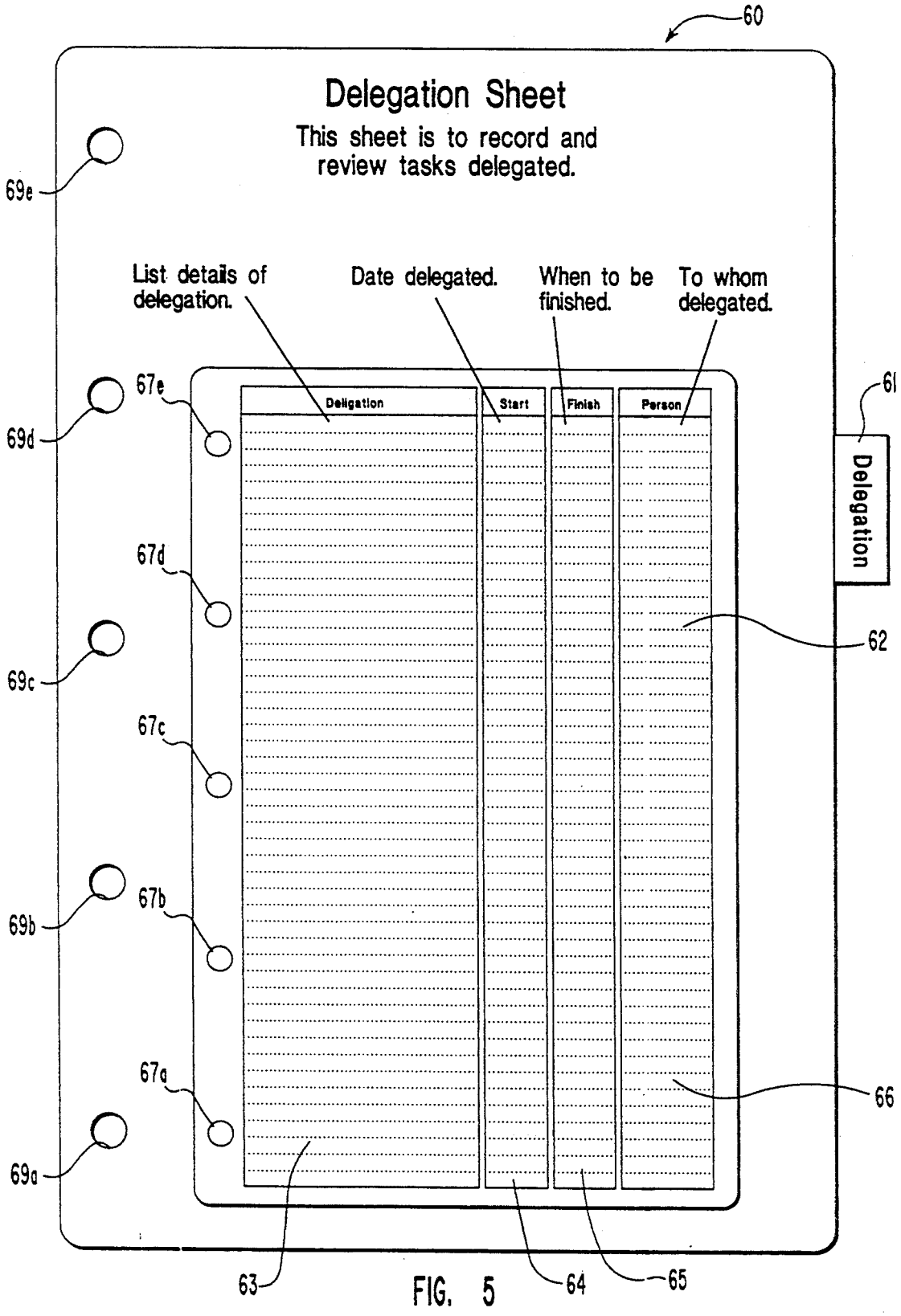
FIG. 5 is a plan view of the Delegation index sheet showing a sample of a Delegation sheet reduced in size and with accompanying instructions for use.

Referring now to FIG. 5, a Delegation index is shown generally at 60 and includes an index tab 61 and a Delegation sheet 62 imprinted thereon in a slightly reduced format in order to accommodate the imprinting of instructions for the use of Delegation sheet 62. Delegation index 60 includes a plurality of spaced holes 69*a*–69*e* for engagement with rings 17*a*–17*e* (FIG. 1), respectively, while Delegation sheet 62 also includes holes 67*a*–67*e* for the same purpose.

Delegation sheet 62 is segregated into four vertical columns under the headings of Delegation column 63, Date column 64, Finish column 65, and Person column 66. Delegation column 63 is designed to identify the task delegated while Person column 66 identifies the person to whom the particular task has been delegated. Date column 64 identifies the date the task was delegated while Finish 65 column identifies the date that the delegated task is to be completed. The user (not shown) is thereby readily able to visually review Delegation sheet 62 and at a glance tell which delegated tasks are completed and which delegated tasks yet to be completed along with the anticipated date for completion.

Advantageously, the system represented by both Assignment sheet 52 (FIG. 4) and Delegation sheet 62 represents a novel advancement in the art over conventional planners in that there is a significant reduction in inadvertent misplacement or forgetting of either assignments received or delegations made with respect to the user. This system specifically identifies both types of tasks in a clearly presented and logical format thereby eliminating either type of task being in effect "buried" within the text of a daily journal entry as found in conventional planners.

Figure 6:
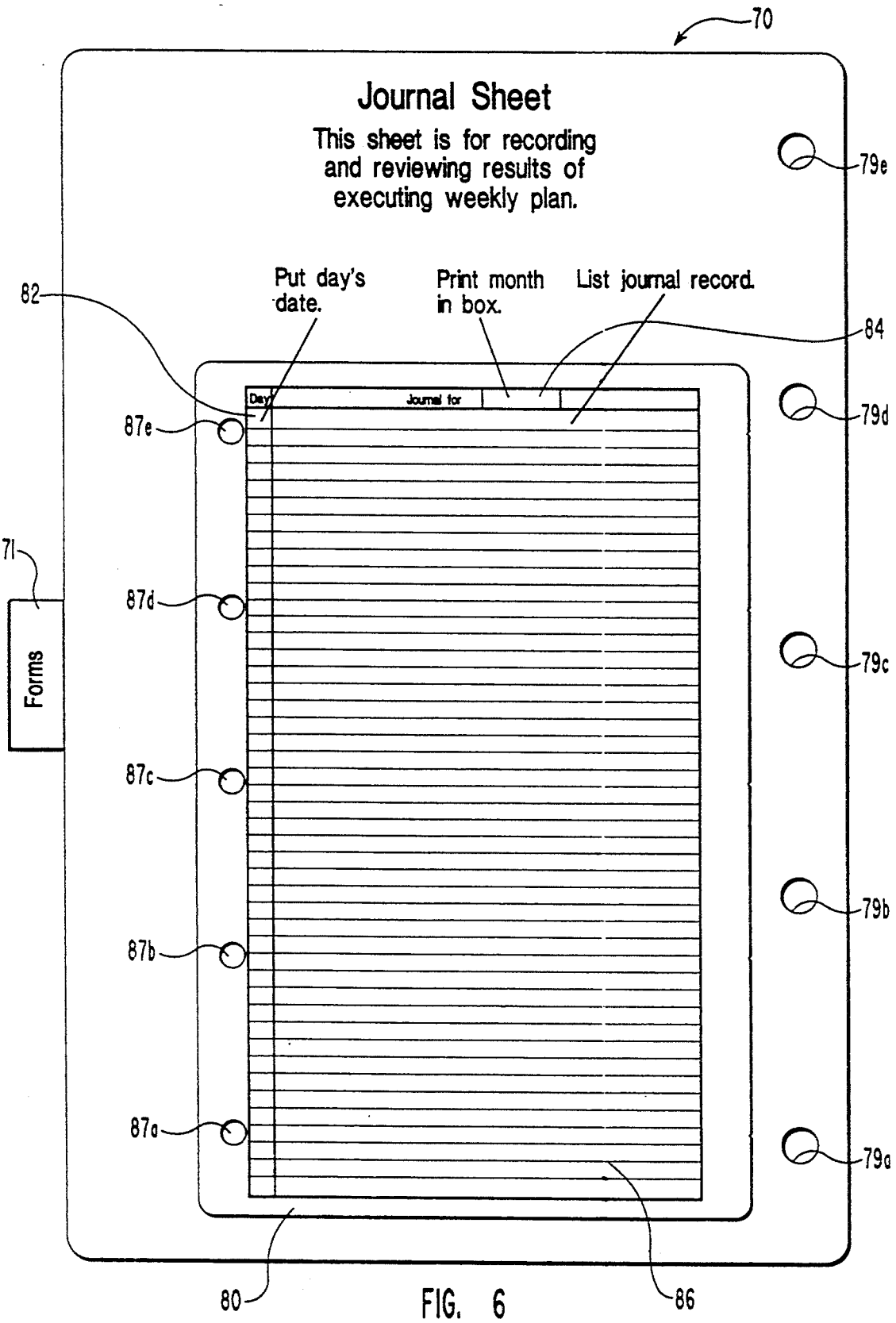
FIG. 6 is a plan view of the Forms index sheet showing a sample of a Journal sheet reduced in size and with accompanying instructions for use.

Referring now to FIG. 6, the reverse side of Week Manager/Organizer index page is shown generally at 70 as Form index page 70 and is shown having a Journal sheet 80 reproduced thereon in reduced format. Journal sheet 80 includes a plurality of spaced holes 87*a*–87*e* which adapt Journal sheet 80 to being mounted on rings 17*a*–17*e*, respectively, of binder 12 (FIG. 1). Journal sheet 80, as the name implies is a sheet of lined paper having a Date column 82, a Month box 84, and a Journal page 86. Date column 82 is intended as a space for the user to record the date of a particular entry while Month box 84 is used to record the month for that particular Journal page 86. Journal page 86 is intended to encourage the user to record journal entries on a regular basis. Importantly the user is presented with a full page available for journal entries without regard to appointments, assignments, or the like, (not shown) which would otherwise consume space on Journal page 86. Journal page 86 provides another advantage in that it allows the user to use Journal page 86 for journal entries for a number of days or, alternatively, record one day's journal entry over a plurality of Journal page 86. Journal sheet 80 provides another advantage in that Journal page 86 is reproduced on both sides of Journal sheet 80 thereby providing the user double the available journal entry space than would otherwise be available.

Advantageously, Week Manager sheet 20 (FIGS. 2A and 2B) and Week Manager sheet 42 (FIG. 3) is easily removed from and reinserted into binder 12 (FIG. 1) as the user progresses through a plurality of Journal sheet 80 thereby easily and efficiently blending the management of tasks both assigned and delegated, priority items, subtask items, appointments, and the like without these various items becoming integrated into the text of the daily journal entries on Journal sheet 80. This feature allows the user to fill each Journal page 86 thereby saving pages in binder 12 with a corresponding reduction in the total volume of binder 12.

Figure 7:
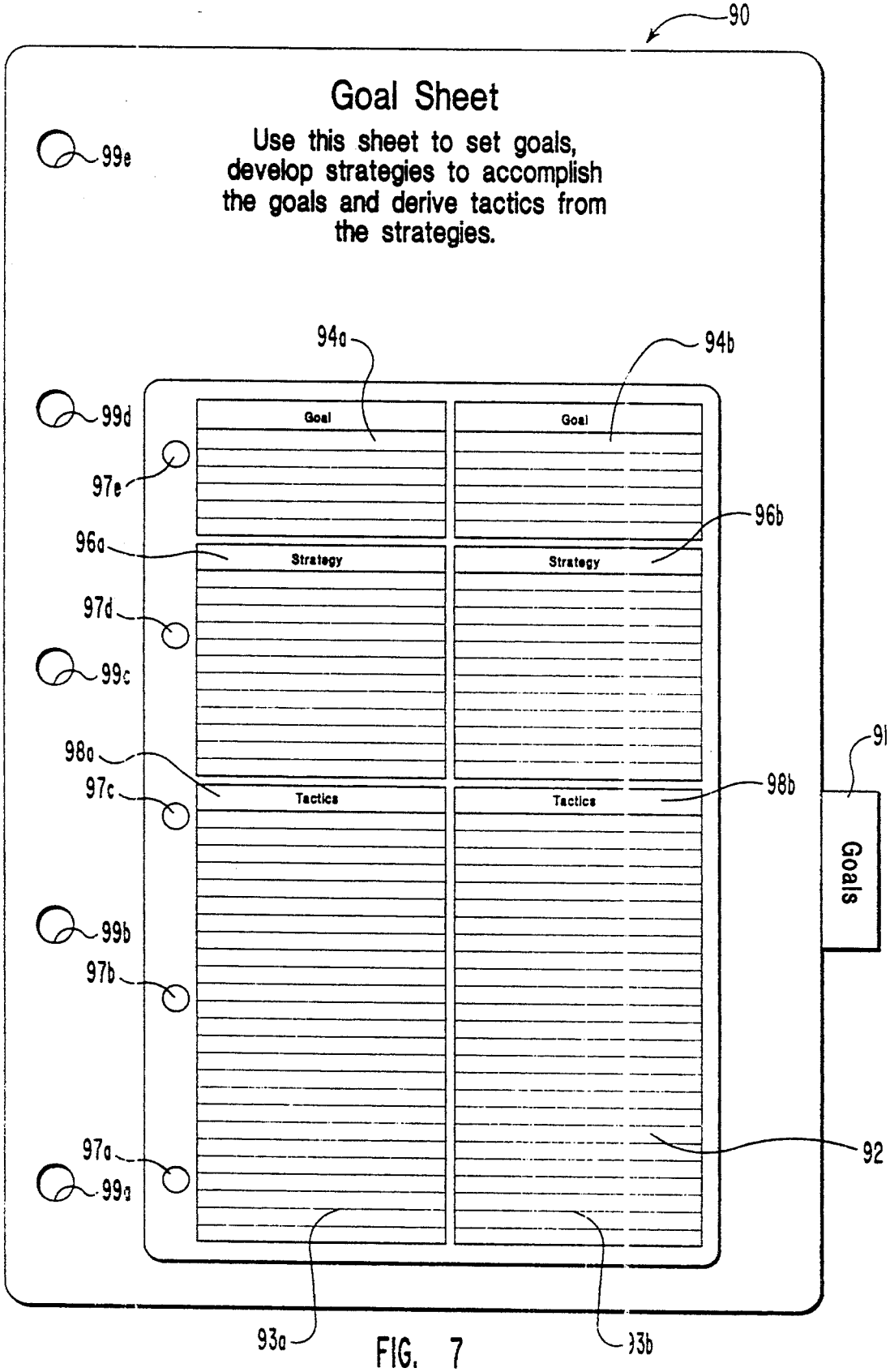
FIG. 7 is a plan view of a Goals index sheet showing a sample of a Goals sheet reduced in size and with accompanying instructions for use.

Referring now to FIG. 7, a Goal sheet is shown generally at 90 and includes an index tab 91. Goal sheet 90 includes a plurality of spaced holes 99*a*–99*e* for mounting Goal sheet 90 to rings 17*a*–17*e* of binder 12 (FIG. 1). A Goal page 92 is imprinted on the face of Goal sheet 90 in reduced form and includes a plurality of spaced holes 97*a*–97*e* for also mounting Goal page 92 to rings 17*a*–17*e*, respectively, of binder 12. Goal page 92 is configured as two, identical vertical columns 93*a* and 93*b*, each of which is segregated into the topic headings of goal, strategy, and tactics. Goal columns 94*a* and 94*b*, Strategy columns 96*a* and 96*b*, and Tactics columns 98*a* and 98*b*, respectively. Goal column 94*a* or 94*b* is designed to enable the user to develop positively stated, written goals toward which the user can strive. The next item under Strategy column 96*a* or 96*b* allows the user to outline the overall strategy or strategic plan for the achievement of the respective goal listed under Goal column 94*a* or 94*b*, respectively. Correspondingly, the tactic entered in Tactic column 98*a* or 98*b* is designed to enable the user to identify and write the various tactics he/she will employ to accomplish a particular strategy under the respective Strategy column 96*a* or 96*b* and thereby advance toward accomplishing the desired goal under the respective Goal column 94*a* or 94*b*.

Figure 8:
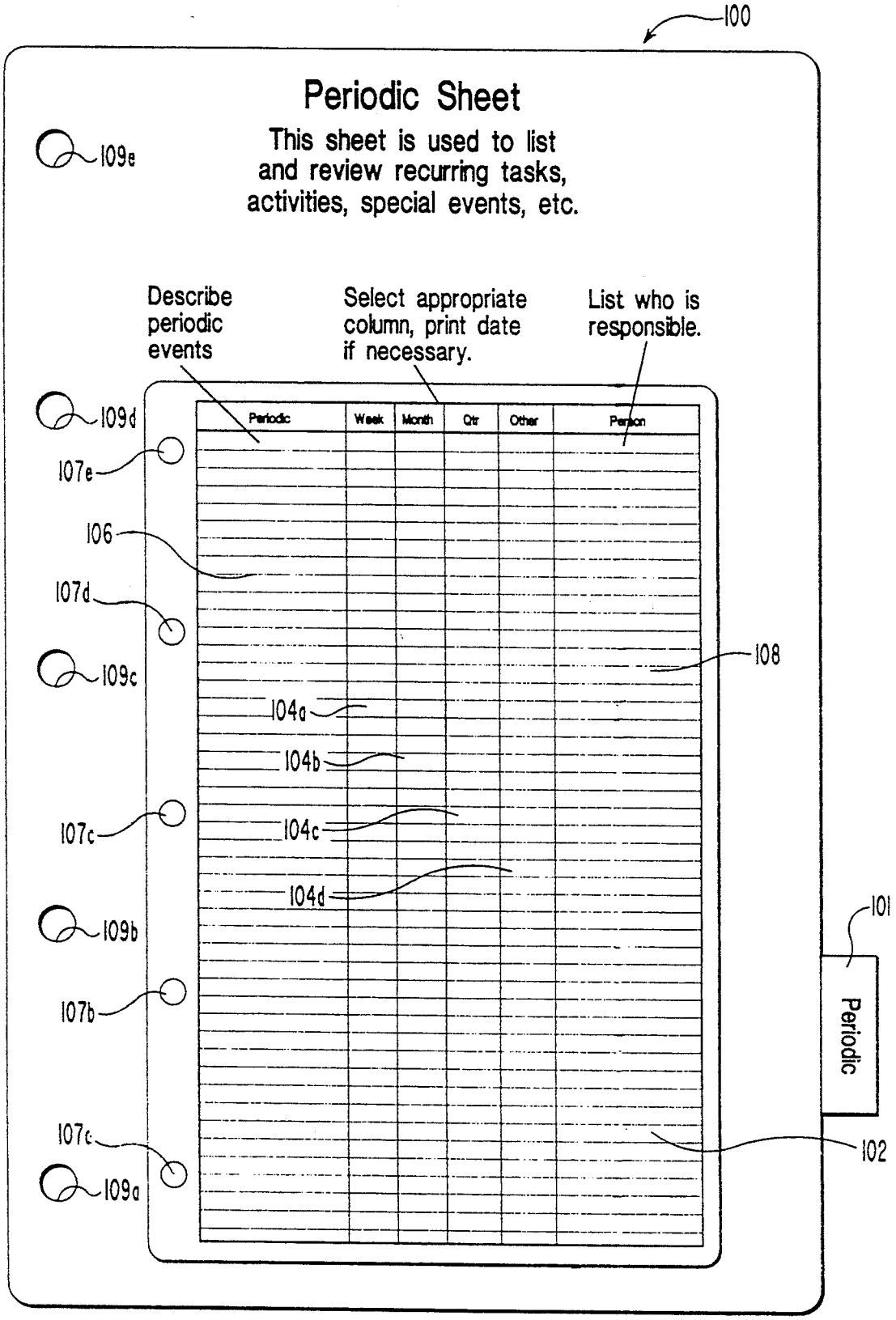
FIG. 8 is a plan view of the Periodic index sheet showing a sample of a Periodic sheet reduced in size and with accompanying instructions for use.

Referring now to FIG. 8, a Periodic sheet is shown generally at 100 and includes an index tab 101 along with a Periodic page 102 imprinted thereon in a reduced format. Periodic sheet 100 includes a plurality of spaced holes 109*a*–109*e* for mounting Periodic sheet 100 to rings 17*a*–17*e*, respectively, of binder 12 (FIG. 1). Periodic page 102 also includes a plurality of spaced holes 107*a*–107*e* for mounting Periodic page 102 to rings 17*a*–17*e*, respectively, of binder 12. Periodic sheet 100 also includes printed instructions for the use of Periodic page 102 or, more particularly, the various columns thereon. Specifically, Periodic page 102 is segregated vertically into a Periodic Event column 106, and four period columns, namely: Week column 104*a*, Month column 104*b*, Quarter column 104*c*, and Other column 104*d*. The remaining column is designated as Person column 108. Periodic page 102 is configured to enable the user to easily identify periodic tasks or events that require attention on a periodic basis. For example, if it is determined that the user needs to have automobile services performed every three months, the user will make the appropriate entry of "Auto Service" in the Periodic Event column 106 followed by an entry in Quarter column 104*c* and the place of service in Person column 108. This enables the user to quickly observe at a glance those items requiring attention on a periodic basis.

The Method

Referring now to all of FIGS. 1–8, novel planner 10 is uniquely configured to enable the respective user (not shown) to advantageously utilize the unique characteristics provided by planner 10 namely, that, of being able to gain control of surrounding conditions, reduce procrastination, set goals, and make regular journal entries thereby effectively eliminating most causes of stress from the user's life. One of the first steps is for the user to determine where he/she is going. This question is important not only to a business concern but is especially important to the individual. Therefore, the user needs to turn to Goal sheet 90 and make the appropriate entries on one or more Goal page 92. These entries will include setting forth each goal under Goal columns 94*a* and 94*b* along with the appropriate strategies under Strategy columns 96*a* and 96*b* followed by the selected tactics under Tactics columns 98*a* and 98*b*.

Correspondingly, the user also turns to Periodic sheet 100 and enters the number of periodic events he/she wishes to track on Periodic sheet 102. These entries are designed to let the user tell at a glance which regularly occurring events will require attention and at which time. This unique feature significantly reduces the stress factors experienced by the user by precluding a certain periodic event from either being overlooked entirely or becoming a last minute crisis which would otherwise interfere with the smooth flow of the user's activities. For example, if the user requires periodic automobile maintenance, say, lubrication along with a change of the oil and oil filter, a listing of this activity on Periodic page 102 will enable the user to schedule such an activity in conjunction with another activity, say, lunch at a nearby restaurant, at the same time. In this manner, Periodic page 102 allows the user to more effectively plan and schedule such periodic events in conjunction with or around other activities such as appointments, or the like. Advantageously, regular tracking along with more efficient scheduling saves the user time while simultaneously significantly reducing stress by eliminating the overwhelmed feeling that could otherwise occur if one were to either forget such a necessary event or remember it at the last minute.

With the goals and periodic events clearly established in planner 10, the user is now free to turn to each of Assignment sheet 50 and Delegation sheet 60 in order to make an entry of all those assignments received and delegations made, respectively. Once entered, each task is assigned a priority as a function of the date to be finished. This allows the user to adjust his/her work schedule, appointments, and the like, in order to meet the necessary commitments.

To further accomplish meeting these commitments, the user inserts Week Manager sheet 20 or 42 adjacent the current Journal page 80 and enters thereon the tasks and subtask items along with a priority for accomplishing these items. Appointments are also entered on Week Manager sheet 20. Therefore, as each day progresses and regular journal entries are made on Journal page 80, the user is able to observe at a glance on Week Manager sheet 20 or 42 the various items requiring attention not only for that particular day but also for the next succeeding days of the week. Importantly, Week Manager sheet 20 or 42 is specifically designed to allow the user to "float" Week Manager sheet 20 or 42 adjacent the respective Journal page 80. The user is encouraged to make regular journal entries on Journal page 80 to provide the user with a very valuable tool, namely, a daily journal having regular entries without interference from having appointments, tasks, periodic events, etc., inserted therein which entries would otherwise unduly clutter journal page 80. More importantly, the index identified by each of Assignment sheet 50, Delegation sheet 60, Goals sheet 90 and Periodic sheet 100 segregate the respective pages thereunder, namely, Assignment page 52 Delegation page 62, Goals page 92, and Periodic page 102, so that each may be examined separately simply by turning to the appropriate index. This simple procedure significantly simplifies the use of planner 10 in that it frees the user from the necessity of searching throughout a plurality of Journal page 80 to find a particular item such as an assignment, a delegation, a goal, or a periodic event.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A planning and journal apparatus comprising:

a loose-leaf binder having a plurality of rings operable to be selectively opened;

a plurality of pages having a plurality of holes along a margin of said pages, said holes corresponding to said rings whereby said pages may be selectively engaged to said rings of said loose-leaf binder;

a week manager sheet selectively insertable into said loose-leaf binder at preselected positions among said pages, said week manager sheet comprising a first margin along a first edge and a second margin along a second edge, said first margin comprising a plurality of spaced first holes spatially corresponding to said rings, said second margin comprising a plurality of spaced, second holes spatially corresponding to said rings, each of said first holes and said second holes comprising a slit extending between each of said first holes and said second holes and the respective edges of said first margin and said second margin, said slits allowing said first holes or said second holes to be selectively engaged about said rings in the absence of opening said rings; and a plurality of index sheets engaged to said rings, each of said index sheets identifying a specific topic.

2. The planning and journal apparatus defined in claim 1 wherein said plurality of pages comprises a pages, each of said sets of pages being configured for said specific topics.

3. The planning and journal apparatus defined in claim 2 wherein said index sheets are imprinted with said configuration of said sets of pages, said index sheet including instructional text for said configuration.

4. The planning and journal apparatus defined in claim 3 wherein said imprinted configuration is reduced in size to accommodate said instructional text.

5. The planning and journal apparatus defined in claim 1 wherein said week manager sheet comprises a two-sided sheet configured with a first portion of a week on a first side and a second portion of said week on a second side.

6. The planning and journal apparatus defined in claim 5 wherein first holes and said second holes adapt said week manager sheet to being selectively insertable into said binder with said first side exposed when said first holes are engaged to said rings and said second side exposed when said second holes are engaged to said rings.

7. The planning and journal apparatus defined in claim 6 wherein said week manager sheet comprises a status check column as a system for rapidly ascertaining the status of an entry on said week manager sheet.

8. The planning and journal apparatus defined in claim 5 wherein said week manager sheet comprises said first portion of a week as the days Monday, Tuesday, and Wednesday with said second portion of a week as the days Thursday, Friday, Saturday, and Sunday, each of said days including sections for daily schedule and appointments.

9. The planning and journal apparatus defined in claim 8 wherein said week manager sheet comprises a first column, a second column, and a third column formed on each of said first side and said second side, said first column comprising a daily task portion, said second column comprising a subtask list, and said third column comprising an appointment calendar, said first and third columns being apportioned by said days of the week.

10. A planning and journal apparatus comprising:

a loose-leaf binder having a spine, a plurality of rings affixed to said spine, said rings being selectively openable to receive pages to be mounted to said rings, and a front cover and a back cover on each side of said spine to enclose said pages therebetween;

a first plurality of said pages releasably mounted to said rings, said first plurality of pages comprising journal pages;

a plurality of week manager sheets selectively insertable between preselected pages of said first plurality of said pages, said week manager sheets comprising a left margin and a right margin, said left margin including a first set of spaced holes and said right margin including a second set of spaced holes, said first set of spaced holes and said second set of spaced holes spatially corresponding to said plurality of rings for releasably and selectively engaging said first set of spaced holes and said second set of spaced holes to said plurality of rings, each hole of said first set of spaced holes and said second set of spaced holes including a transverse slit connecting said hole with the respective edge of said weekly planning sheet, said slit allowing passage of respective ring of said plurality of rings through said slit into and out of said respective hole in the absence of opening said set of rings;

a plurality of indices in said loose-leaf binder, each index of said plurality of indices segregating said loose-leaf binder into a separate subject heading for said planning and journal apparatus, each subject heading comprising a preprinted page specifically configured to said subject heading; and a reduced image of said preprinted page printed on a respective index of said plurality of indices.

11. The planning and journal apparatus defined in claim 10 wherein said week manager sheet comprises a two-sided page having a first side and a second side, said first side including the days of a first portion of a week and said second side including the days of a second portion of said week.

12. The planning and journal apparatus defined in claim 11 wherein said week manager sheet comprises a daily task column and an appointment column imprinted on said first side and said second side, each of said daily task column and said appointment column being apportioned horizontally into specific days of a week.

13. The planning and journal apparatus defined in claim 12 wherein said week manager sheet includes a subtask column on said first side and said second side, said subtask column comprising a reminder to selectively check the specific subtask identified relative to each task.

14. A method for using a planning and journal apparatus comprising the steps of:

obtaining a loose-leaf binder, said loose-leaf binder comprising a spine, a front cover, a back cover, and a plurality of rings mounted to said spine, said rings being selectively openable to receive and release pages from said loose-leaf binder;

segregating said loose-leaf binder into a plurality of subject headings with a plurality of indices, each index of said plurality of indices having a preselected subject heading;

providing a week manager sheet for enabling the user of said planning and journal apparatus to regularly access said subject headings on a daily basis;

selecting one of said indices as a journal for regular journal entries; and moving said week manager sheet through said journal as a function of said journal entries by selectively inserting said week manager sheet between pages of said journal.

15. The method defined in claim 14 wherein said moving step comprises forming holes in said week manager sheet, said holes spatially corresponding to said plurality of rings, slitting said week manager sheet at said holes to open said holes through said slits, removably mounting said week manager sheet to said rings among said journal by selectively slipping said slits over said rings in the absence of opening said rings.

16. The method defined in claim 14 wherein said selecting step includes printing a page identified by a specific index, an index sheet carrying said index, said printing including displaying instructions for using said page on said index sheet.

17. The method defined in claim 14 wherein said providing step includes printing a subtask column on said week manager sheet as a reminder to refer to specific indices in said binder.

* * * * *